US007665521B2

(12) United States Patent
Carlson

(10) Patent No.: US 7,665,521 B2
(45) Date of Patent: Feb. 23, 2010

(54) SAFETY CEMENT PLUG LAUNCH SYSTEM

(75) Inventor: Bradley T. Carlson, Cypress, TX (US)

(73) Assignee: BJ Services Company, Houston, TX (US)

( * ) Notice: Subject to any disclaimer, the term of this patent is extended or adjusted under 35 U.S.C. 154(b) by 292 days.

(21) Appl. No.: 11/786,418

(22) Filed: Apr. 11, 2007

(65) Prior Publication Data

US 2008/0251249 A1 Oct. 16, 2008

(51) Int. Cl.
*E21B 33/16* (2006.01)

(52) U.S. Cl. ..... 166/291; 166/153

(58) Field of Classification Search ..... 166/153, 166/75.15, 291, 285
See application file for complete search history.

(56) References Cited

U.S. PATENT DOCUMENTS

| | | | | |
|---|---|---|---|---|
| 4,782,894 | A | 11/1988 | LaFleur | 166/70 |
| 4,854,383 | A | 8/1989 | Arnold et al. | 166/70 |
| 5,040,603 | A | 8/1991 | Baldridge | 166/291 |
| 5,095,988 | A * | 3/1992 | Bode | 166/291 |
| 5,856,790 | A | 1/1999 | Bauhg et al. | 340/854.6 |
| 6,302,199 | B1 | 10/2001 | Hawkins et al. | 166/70 |
| 6,575,238 | B1 * | 6/2003 | Yokley | 166/75.15 |
| 7,413,008 | B2 * | 8/2008 | Basso | 166/90.1 |
| 2003/0132002 | A1 | 7/2003 | Giebeler et al. | 166/365 |
| 2006/0237186 | A1 | 10/2006 | Mondelli et al. | 166/70 |
| 2007/0131416 | A1 * | 6/2007 | Odell et al. | 166/250.1 |

FOREIGN PATENT DOCUMENTS

| | | |
|---|---|---|
| EP | 0450676 | 10/1991 |
| EP | 0500165 | 8/1992 |
| EP | 1083298 | 3/2001 |
| EP | 1340882 | 9/2003 |
| GB | 2276403 | 9/1994 |
| WO | WO 98/48143 | 10/1998 |

OTHER PUBLICATIONS

International Search Report and Written Opinion dated Mar. 19, 2009, for PCT Application No. PCT/US2008/060066, filed Apr. 11, 2008.

* cited by examiner

*Primary Examiner*—Shane Bomar
(74) *Attorney, Agent, or Firm*—Howrey LLP

(57) ABSTRACT

A system and method for using a pneumatic line to automate the launch a cement plug from a cement head. The pneumatic line is in communication with the valves and retaining devices normally found on a typical cement head. The system ensures that the proper sequence of opening and closing valves in combination with the removal of the retaining device is used to safely launch a cement plug from the cement head. The pressure in the single pneumatic line may be varied to launch multiple cement plugs from a cement head. The system may be used to remotely launch a cement plug from a cement head. A wireless remote may be used to regulate the pressure in the pneumatic line to launch cement plugs from the cement head as desired.

25 Claims, 9 Drawing Sheets

SAFETY CEMENT PLUG LAUNCH SYSTEM

BACKGROUND OF THE INVENTION

1. Field of the Invention

The present invention relates generally to a system and method for using a pneumatic line to automate the launch of a cement plug or multiple cement plugs from a cement head. The system ensures that the proper sequence of opening and closing valves in combination with the removal of a retaining device is done to safely launch a cement plug. The present invention discloses varying the pressure in a single pneumatic line to launch multiple cement plugs from a cement head. A wireless remote may be used to regulate the pressure in the pneumatic line to launch cement plugs from the cement head as desired from a remote location.

2. Description of the Related Art

Oil and gas wells typically include steel casing or steel tubing, hereinafter steel casing, cemented into the wellbore to provide support to the wellbore and prevent the wellbore from collapsing. The cement casing is important to support the wellbore formation as well as to help protect the steel casing from being damaged. The first process in creating an oil or gas well is to drill the wellbore or at least a portion of the wellbore. The industry typically uses drilling mud to aid in the drilling process to remove the drill cuttings from the wellbore. The drilling mud typically remains in the wellbore until displaced during the cementing process.

After the wellbore has been drilled to the desired depth, the drilling apparatus is removed and steel casing is inserted into the wellbore. Cement slurry is then pumped into the interior of the casing to cement in the steel casing. The cement slurry flows up in the annulus outside the casing up to a desired level. The cement slurry displaces the drilling mud present in the wellbore and the drilling mud is circulated out of the well. The hardened cement provides support to the wellbore formation as well has helping to protect the steel casing from being damaged. Further, the cement prevents the migration of formation fluids.

During the cementing process it is important to prevent the contamination of the cement slurry with the drilling mud. A cement plug may be launched ahead of the cement slurry. The cement plug helps to separate the cement slurry from the drilling mud present in the wellbore. A second cement plug may be launched after the injection of the cement slurry to help prevent possible contamination of the cement. The cement plugs may be drilled out once the cement casing has hardened in the annulus between the steel casing and the formation.

A cement head is generally attached to the top of the casing to facilitate the cementing of the casing. The cement head generally includes a chamber that holds one or more cement plugs inside the cement head. A retaining device, such as a pin, may be inserted into the cement head to prevent the cement plugs from prematurely exiting the cement head. The cement head also includes ports generally located above and below each plug within the cement head. The port below a plug allows material to be pumped into the well prior to launching the plug into the wellbore while the port above a plug allows material to be pumped into the chamber causing the plug to be launched out of the cement head into the wellbore. The cement head generally includes valves that may be used to open or close the ports in the cement head. The cement head may include a various number of cement plugs and configurations, but for illustrative purposes, a cement head containing a first plug, a second plug, and three ports having valves will be discussed below.

The first port of the cement head is located below the first plug and allows material, such as drilling mud, to be pumped into the wellbore prior to launching the first plug. After it is no longer necessary to pump the drilling mud into the wellbore the device retaining the plug may be removed, the valve to the second port may be opened, and the valve to the first port may be closed. The second port may be located below a second plug and above the first plug. With the second port being open, material such as cement slurry may be pumped into the cement head. The cement slurry above the first plug causes the first plug to be launched into the wellbore. The first plug may act as a spacer between the first material pumped into the wellbore and the cement slurry pumped above the first plug. Cement slurry may be pumped through the second port until a sufficient amount of cement slurry has been pumped to complete the desired cementing process.

After enough cement slurry has been pumped into the wellbore, the device retaining the second plug may be removed or released, the valve to a third port located above the second plug may be opened, and the valve to the second port may be closed. Material may be pumped into the cement head above the second plug causing the second plug to be launched into the wellbore, the second plug may act as a spacer between the cement in the wellbore and the material pumped in above the second plug.

To launch a cement plug, an operator has to manually actuate the valves and remove or release the retaining device as described above. This can be a potentially unsafe activity as the cement head is often located on a derrick high above the wellhead. The cement head is often located in an area considered a zone zero in some regions, such as the North Sea, which is considered hazardous due to the possibility of combustible gases being present. The location of the cement head in a zone zero prevents the use of an electrical device to actuate the valves or manipulate the retaining devices because a spark from the electrical device could ignite combustible gas that may be present.

It would be beneficial to provide a system or apparatus that may be used to remotely launch a cement plug from the cement head, but the location of the cement head in a zone zero may prevent the use of an electrical device to launch the cement plug. One potential solution would be to use a pneumatic system to actuate the cement head valves and to remove the retaining devices. However, such a system may be too cumbersome and complex if a pneumatic line needs to be connected to each valve and each retaining device of the cement head.

The manual operation of the cement head may also be potentially hazardous if the valves and the releasing of the retention device are not operated properly. For example, cement slurry is often pumped into the cement head at a high pressure. The launching of a cement plug requires that two valves and a retaining device be actuated in a proper sequence as discussed above. The premature closure of a valve or failure to remove the retaining device may cause an accident to occur because of the high pressure slurry being pumped into the cement head. Thus, it would be beneficial to provide a system that automates the launching of the cement head ensuring that the valves and retention devices are operated in the proper sequence.

In light of the foregoing, it would be desirable to provide a system that can launch cement plugs from a cement head from a remote location. It would be further desirable to provide a system that prevented the premature opening of a valve or removal of a retaining device prior to launching a cement plug. It would also be desirable to provide a pneumatic system that only required a single pneumatic line to launch multiple cement plugs from a cement head. It would be further desirable to provide a system that automated the launching of cement plugs from a cement head.

The present invention is directed to overcoming, or at least reducing the effects of, one or more of the issues set forth above.

SUMMARY OF THE INVENTION

The object of the present disclosure is to provide a system that can remotely launch a cement plug from a cement head. One embodiment is system for launching a cement plug from a cement head. A cement head typically includes a first retaining device movable from a first position that retains a first cement plug in the cement head to a second position that allows the first cement plug to exit the cement head. The system includes a pneumatic line, the pneumatic line containing a pressurized gas, wherein the pressure within the line may be varied. The pressure may be varied by connecting to various pressure regulators. The regulators may be set at predetermined pressure amounts to ensure the proper sequence of launching a cement plug.

The system includes a first device being in communication with the pneumatic line, the first device being adapted to move the first retaining device from its first position to its second position, wherein the first device moves the first retaining device to its second position when the pressure within the pneumatic line reaches exceeds a first designated amount. The first device may be, for example, a pneumatically actuated pin puller. The a number of various devices that may be pneumatically actuated to release the cement plug as would be appreciated by one of ordinary skill in the art having the benefit of this disclosure. Further, the device may be hydraulically actuated as would be recognized by one of ordinary skill in the art having the benefit of this disclosure.

The system includes a first control valve in communication with the pneumatic line, the first control valve being adapted to actuate a first valve between an open position and a closed position. The first valve is located below the first cement plug on the cement head. The system includes a second control valve in communication with the pneumatic line, the second control valve being adapted to actuate a second valve between an open position and a closed position. The second valve is located above the first cement plug on the cement head. In place of a control valve, the system may use a device, such as various transducers, that converts pneumatic or hydraulic pressure into linear motion as would be appreciated by one of ordinary skill in the art having the benefit of this disclosure. The linear motion of such a device may be used to release the device used to retain the cement plug, close a valve on the cement head, or open a valve on the cement head.

The second control valve of the system is biased to close the second valve until the first retaining device has been moved to the second position. The first control valve of the system is biased keep the first valve open until the second valve has been opened. After the second valve has been opened, the first control valve may close the first valve. With this configuration, the system may ensure that the proper sequence of removing the retention device and opening and closing the valves on the cement head so that the cement plug is safely launched.

The system may also include a first pressure regulator used to regulate the pressure in the pneumatic line. The first pressure regulator may be biased to keep the pressure in the pneumatic line less than the first designated pressure until the operator is ready to launch a cement plug from the cement head. The system may also include a second pressure regulator used to increase the pressure in the pneumatic line to exceed a first designated pressure when the operator is ready to launch the cement plug from the cement head. Alternatively, a variable pressure regulator may be used to control the amount of pressure in the pneumatic line.

The system may further include a second device in communication with the pneumatic line, the second device being adapted to move a second retaining device of the cement head from a first position to a second position. In the first position the second retaining device retains a second cement plug in the cement head and in the second position the second cement may exit the cement head. The second device may be adapted to move to its second position when the pressure within the pneumatic line exceeds a second designated amount.

The system may include a third control valve in communication with the pneumatic line, the third control valve being adapted to actuate a third valve between an open position and a closed position. The third valve is located above the second cement plug on the cement head. The third control valve may be biased to keep the third valve closed until the second retaining device has been moved to its second position and the second control valve may hold open the second valve until the third valve has been opened.

A third pressure regulator of the system may be used to raise the pressure in the pneumatic line above a second designated amount upon receiving a signal to launch the second cement plug. A wireless remote may be used to control the pressure regulators.

Another embodiment is a system for remotely launching a cement plug that includes a pneumatic line connected to the cement head, a plurality of pressure regulator for controlling pressure in the pneumatic line, and means for remotely releasing a device used to retain a first cement plug in the cement head. A variable pressure regulator may be used in place of the plurality of pressure regulators as would be recognized by one of ordinary skill in the art having the benefit of this disclosure. The system also includes means for remotely opening a valve above the first cement plug, wherein the valve may not be opened until the device used to retain the first cement plug has been released. The system includes means for remotely closing a valve below the first cement plug, wherein the valve below the first cement plug is closed after the valve above the first cement plug has been opened.

The system may include means for remotely releasing a device used to retain a second cement plug in the cement head, wherein the second cement plug is located above the first cement plug. The system may also include means for remotely opening a valve above the second cement plug, wherein the valve may not be opened until the device used to retain the second cement plug has been released. The system may further include means for remotely closing a valve between the first cement plug and the second cement plug, wherein the valve between the first cement plug and the second cement plug is closed after the valve above the second cement plug has been opened.

Pressure may be used to actuate the means for remotely releasing the device used to retain the first cement plug in the cement head, to actuate the means for remotely opening the valve above the first cement plug, and to actuate the means for remotely closing the valve above the first cement plug. Pressure may be used to actuate the means for remotely releasing the device used to retain the second cement plug in the cement head, to actuate the means for remotely opening the valve above the second cement plug, and to actuate the means for remotely closing the valve between the first cement plug and the second cement plug.

Another embodiment is a method of remotely launching cement plugs from a cement head. The method includes raising the pressure in a pneumatic line above a first designated pressure, wherein the pneumatic line is in communication with the cement head and removing a first pin from the cement head, the first pin retains a first cement plug in the cement head, wherein the first pin is pneumatically removed after the pressure in the pneumatic line exceeds the first designated pressure.

The method includes opening a valve located above the first cement plug on the cement head, wherein the valve is pneumatically biased closed until the first pin has been removed from the cement head and pumping cement through the valve above the first cement plug. The method further includes closing a valve located below the first cement plug on the cement head, wherein the valve is pneumatically biased open until the valve above the first cement plug has been opened.

The method may further include regulating the pressure in the pneumatic line. The pressure may be remotely regulated. The method may include raising the pressure in the pneumatic line above a second designated pressure and removing a second pin from the cement head, the second pin retains a second cement plug in the cement head, wherein the second pin is pneumatically removed after the pressure in the pneumatic line exceeds the second designated pressure.

The method may include opening a valve located above the second cement plug on the cement head, wherein the valve is pneumatically biased closed until the second pin has been removed from the cement head, pumping cement through the valve above the second cement plug, and closing the valve located above the first cement plug on the cement head, wherein the valve is located below the second cement plug.

Figure 1A:
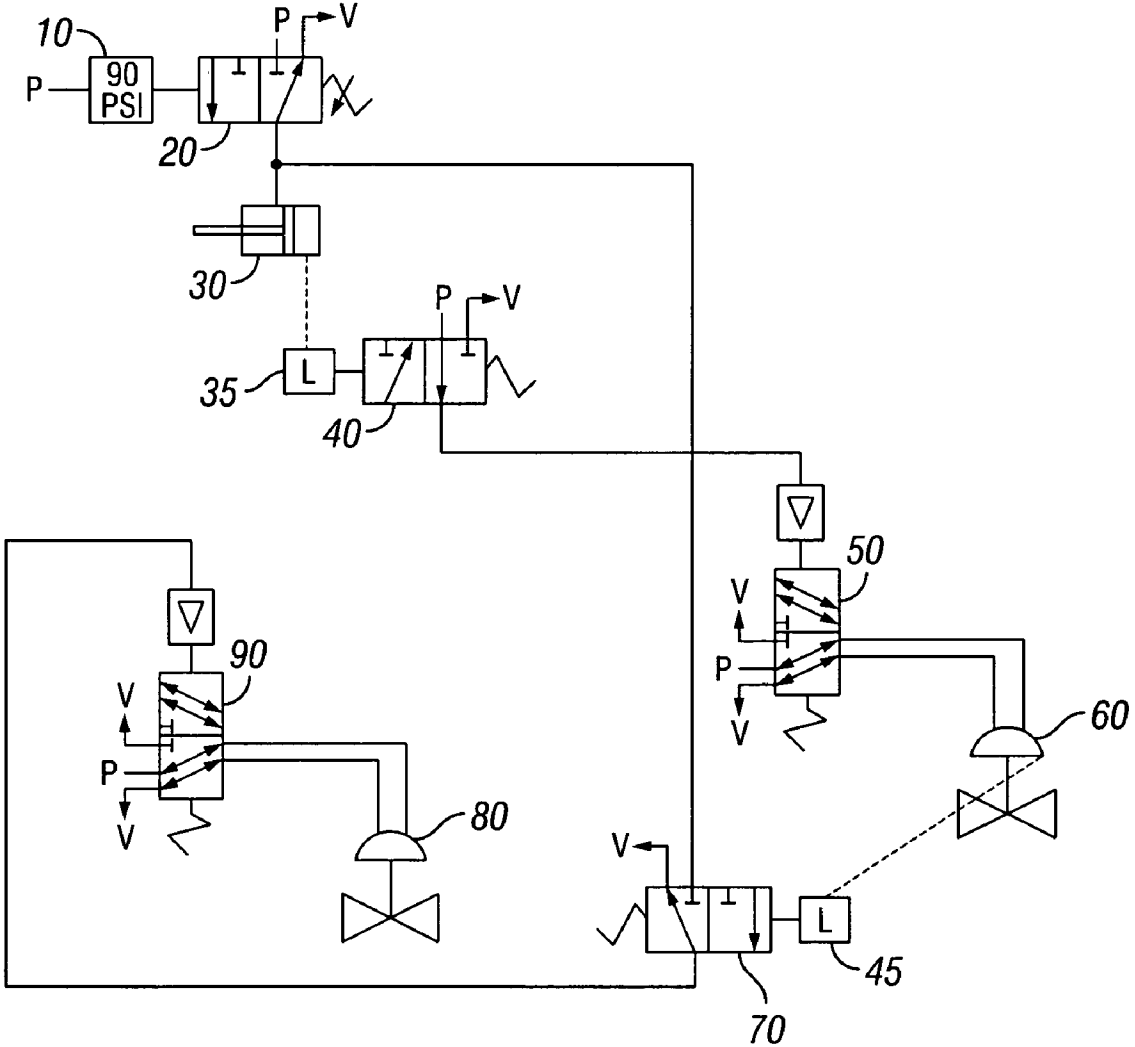
FIG. 1A shows a schematic of one embodiment of the present disclosure that may be used to launch a single cement plug from a cement head.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in system that automates the launching of a cement plug from a cement head. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1A shows a schematic of a system of one embodiment that may be used to launch a single cement plug from a cement head. The system includes a single pneumatic line that is connected to various components of the cement head. The single line running to the cement head decreases the complexity as opposed to running a pneumatic line to each component of the cement head. P is used in the schematic to designate the presence of pressure and V is used to designate with a valve is vented.

The system includes a first pressure regulator 10 that is used to raise the pressure in the pneumatic line above a predetermined pressure. For illustrative purposes only, the first predetermined pressure is shown as 90 psi. However, the actual amount of the first predetermined pressure may be varied depending on the application and components being used on the cement head as would be appreciated by one of ordinary skill in the art having the benefit of this disclosure. Once the pressure in the pneumatic line reaches or exceeds the first predetermined amount, a valve 20 is actuated causing a pin puller 30 to remove the pin that is retaining the cement plug. The use of a pin puller 30 to remove a pin used a retaining device is for illustrative purposes only. The disclosed system may be adapted to remove or release various retention devices used to retain a cement plug within a cement head as would be appreciated by one of ordinary skill in the art having the benefit of this disclosure.

The pin puller 30 removes the pin and trips a limit switch 35 which causes valve 40 to vent. Valve 40 is in communication with control valve 50. Control valve 50 is biased to keep the upper valve 60 of the cement head in its closed position while pressure is applied to the control valve 50. The venting of valve 40 causes the release of pressure from the control valve 50 which actuates the upper cement head valve 60 to its open position. The opening of the upper cement head valve 60 allows for cement to be pumped into the cement head through the upper port to launch the cement plug into the wellbore.

The actuation of the upper cement head valve 60 trips a limit switch 45 which causes valve 70 to move from a venting position to a closed position. With valve 70 in its closed position, pressure is now applied to control valve 90. Control valve 90 is biased to actuate the lower cement head valve 80 to its closed position when pressure is applied to the control valve 90. The closing of valve 70 causes pressure to be present at control valve 90 closing the lower cement head valve 80. The system uses pressure to automate the launching of a cement plug from a cement head. Further, the limit switches and biased valves and control valves creates interlocks in the system preventing the improper sequencing of the cement head valves.

Figure 1B:
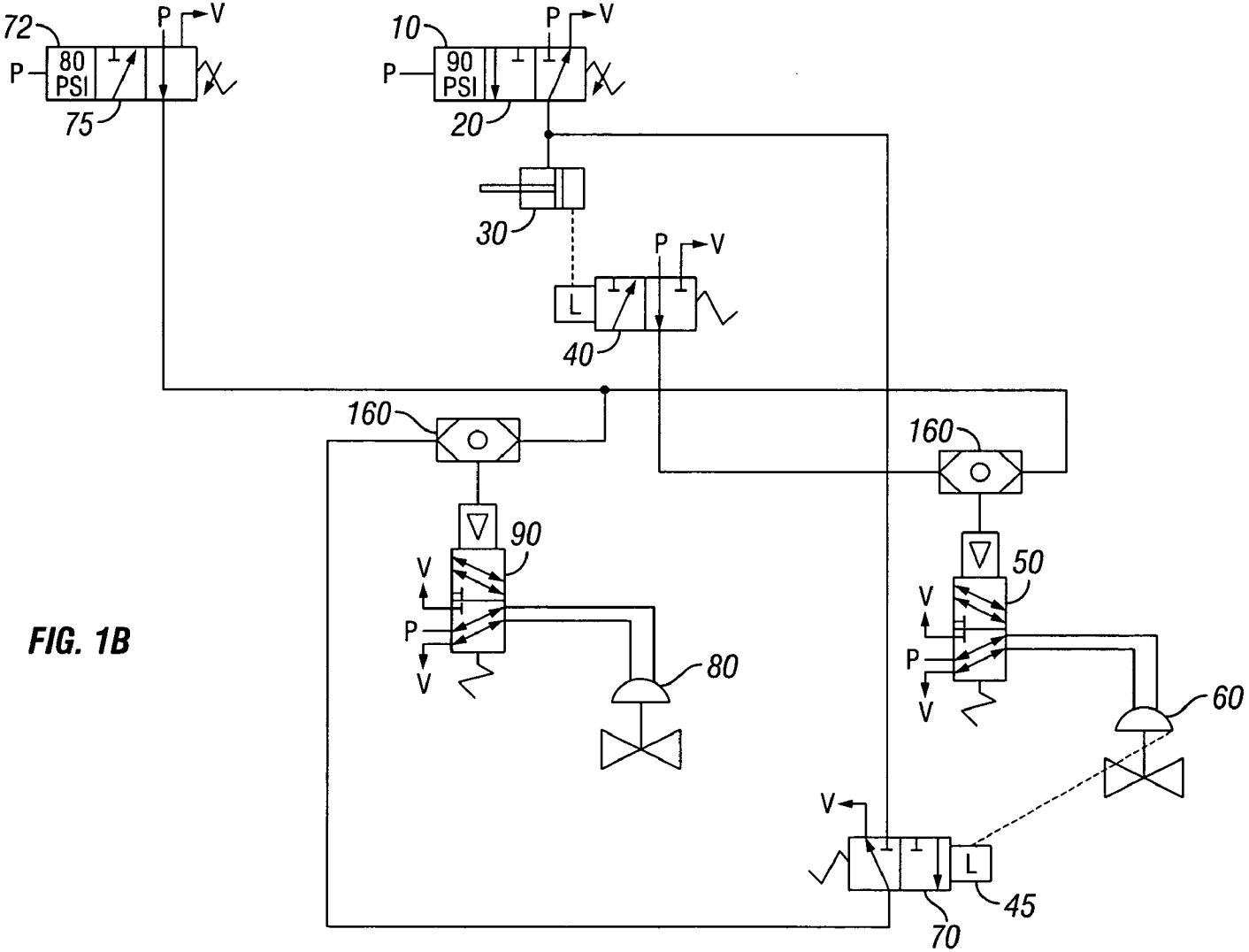
FIG. 1B shows a schematic of one embodiment of the present disclosure that may be used to launch a single cement plug from a cement head that includes an override switch that may used to simultaneously actuate each of the cement head valves.

FIG. 1B shows a schematic of a system of one embodiment that may be used to launch a single cement plug from a cement head with the addition of an override pressure regulator 72 that may be used to raise the pressure in the pneumatic line above a predetermined pressure overriding the operation of the cement head valves 60, 80. The override pressure regulator 72 in combination with an override valve 75 may be used to simultaneously actuate each of the cement head valves 60, 80 between their open and closed positions. For illustrative purposes only, the predetermined pressure for the override regulator is shown as 80 psi. However, the actual amount of the predetermined pressure for the override regulator may be varied depending on the application and components being used on the cement head as would be appreciated by one of ordinary skill in the art having the benefit of this disclosure. As shown in FIG. 1B, the override valve 75 bypasses the valves 20, 40 and the pin puller 30 used to launch the cement plug from the cement head and is instead connected directly to both the upper cement head valve 60 and the lower cement head valve 80. Thus, the override valve 75 may be used to actuate both the cement head valves 60, 80 simultaneously.

Figure 2A:
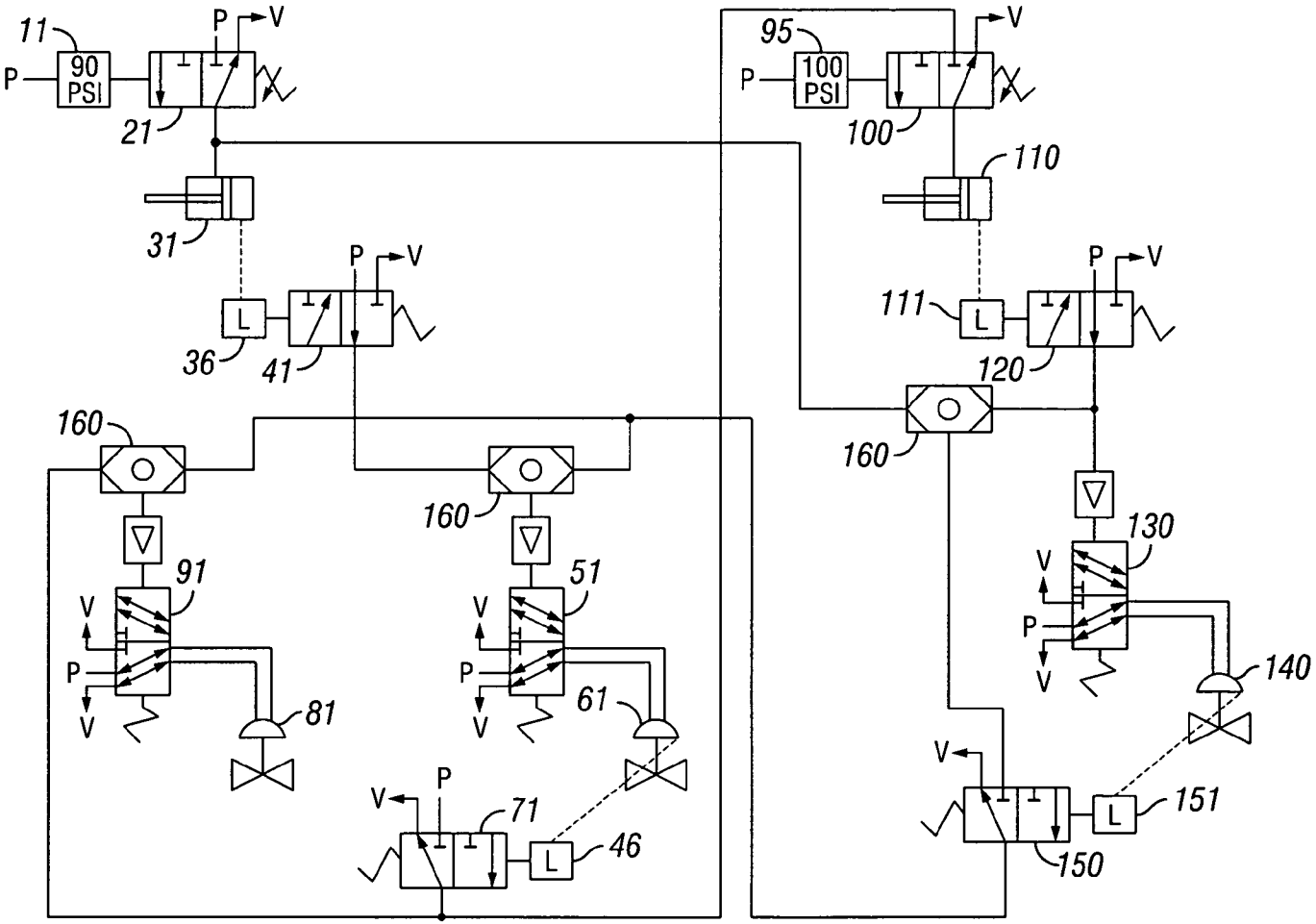
FIG. 2A shows a schematic of one embodiment of the present disclosure that may be used to launch two cement plugs from a cement head.

FIG. 2 shows a schematic of a system of one embodiment that may be used to launch a lower cement plug and an upper cement plug from a cement head. As in FIG. 1, the system includes a single pneumatic line that is connected to various components of the cement head. The system functions on the same principles as the embodiment of FIG. 1, but also uses shuttle valves 160 due because of the greater complexity of the system. Specifically, the presence of a second cement plug causes two inputs causing the actuation of the control valves used to open the cement head valves. The number of cement plugs being launched from the cement head is for illustrative purposes only. The actual number of cement heads automatically and/or remotely launched by the disclosed invention may be varied as needed as would be appreciated by one of ordinary skill in the art having the benefit of this disclosure.

The system of FIG. 2 includes a first pressure regulator 11 used to raise the pressure in the pneumatic line above a predetermined pressure, which is shown as 90 psi only for illustrative purposes as discussed above. Once the pressure in the pneumatic line reaches or exceeds the first predetermined amount, a valve 21 is actuated causing a pin puller 31 to remove the pin used retain the lower cement plug within the cement head. The pin puller 31 removes the pin releasing the lower cement plug within the cement head and also trips a limit switch 36 causing valve 41 to vent. Valve 41 is in communication with a first control valve 51. The first control valve 51 is biased to keep a middle valve 61 of the cement head in its closed position while pressure is applied to the first control valve 51. The middle valve 61 is in communication with a port in the cement head that is located above the lower cement plug and below the upper cement plug.

The venting of valve 41 causes the release of pressure from the control valve 51, which actuates the middle cement head valve 61 to its open position. The opening of the middle cement head valve 61 allows for cement to be pumped into the cement head through the middle port to launch the lower cement plug into the wellbore. The actuation of the middle cement head valve 61 trips a limit switch 46 causing a valve 71 to move from a venting position to a closed position. With the valve 71 in its closed position, pressure is now applied to a second control valve 91. The second control valve 91 is biased to keep a lower cement head valve 81 to its closed position while pressure is applied to the second control valve 91. The closing of valve 71 causes pressure to be present at the second control valve 91 thus closing the lower cement head valve 81. The disclosed system uses pressure to automate the launching of a cement plug from a cement head. Further, the limit switches and biased valves and control valves creates interlocks in the system preventing the improper sequencing of the cement head valves.

The system includes a second pressure regulator 95 used to raise the pressure in the pneumatic line above a second predetermined pressure, which is shown as 100 psi only for illustrative purposes. Once the pressure in the pneumatic line reaches or exceeds the second predetermined amount, a valve 100 is actuated causing a second pin puller 110 to remove the pin used retain the upper cement plug within the cement head. The pin puller 110 removes the pin releasing the upper cement plug within the cement head and also trips a limit switch 111 causing valve 120 to vent. Valve 120 is in communication with a third control valve 130. The third control valve 130 is biased to keep an upper valve 140 of the cement head in its closed position while pressure is applied to the third control valve 130. The upper cement head valve 140 is in communication with an upper port in the cement head that is located above the upper cement plug.

The venting of the valve 120 causes the release of pressure from the third control valve 130, which actuates the upper cement head valve 140 to its open position. The opening of the upper cement head valve 140 allows for a material, such as a spacer, to be pumped into the cement head through the upper port launching the upper cement plug into the wellbore. The actuation of the upper cement head valve 140 trips a limit switch 151 causing a valve 150 to move from a venting position to a closed position. With the valve 150 in its closed position, pressure is now again applied to the first control valve 91 thus closing the middle cement head valve 61. The upper cement plug may now be launched safely into the wellbore with the middle cement head valve 61 in its closed position.

Figure 2B:
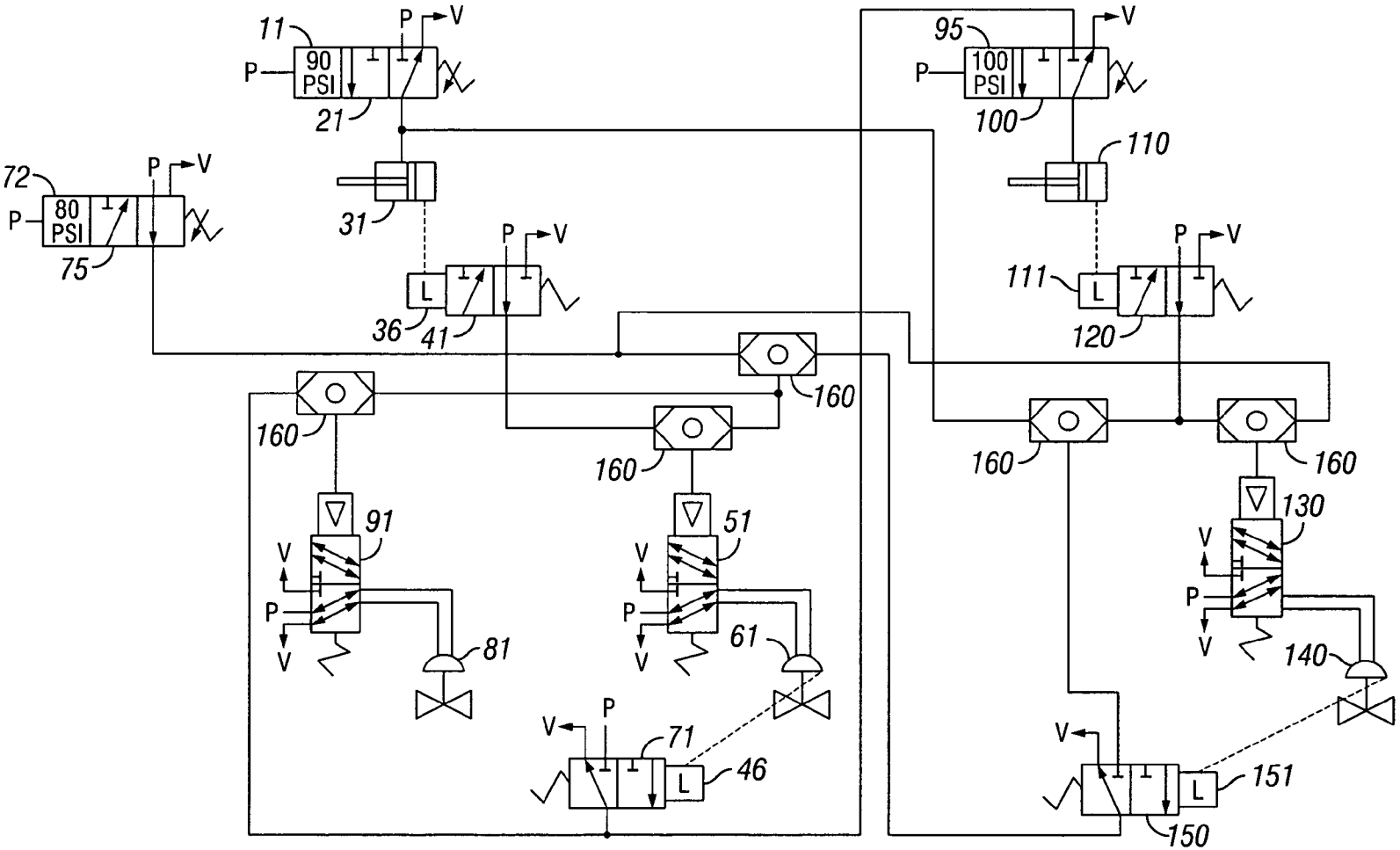
FIG. 2B shows a schematic of one embodiment of the present disclosure that may be used to launch two cement plugs from a cement head that includes an override switch that may used to simultaneously activate each of the cement head valves.
Figure 6:
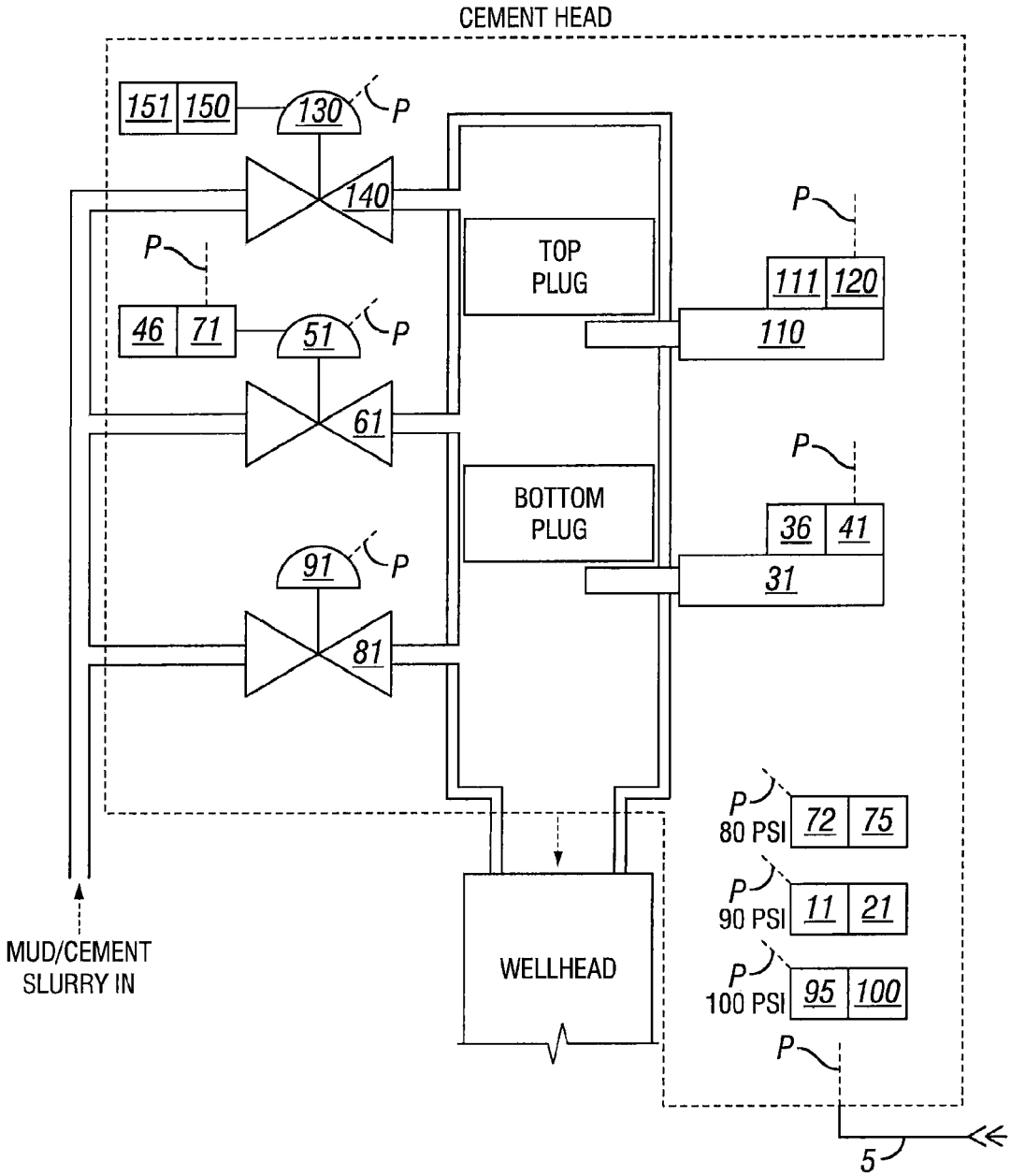
FIG. 6 is a simplified pictorial illustration of the exemplary schematic of FIG. 2B.

FIG. 2B shows a schematic of a system of one embodiment that may be used to launch a lower cement plug and an upper cement plug from a cement head with the addition of an override pressure regulator 72 that may be used to raise the pressure in the pneumatic line above a predetermined pressure overriding the operation of the cement head valves 61, 81, and 140. FIG. 6 illustrates a pictorial view of FIG. 2B. The override pressure regulator 72 in combination with an override valve 75 may be used to simultaneously actuate each of the cement head valves 61, 81, and 140 between their open and closed positions. For illustrative purposes only, the predetermined pressure for the override regulator is shown as 80 psi. However, the actual amount of the predetermined pressure for the override regulator may be varied depending on the application and components being used on the cement head as would be appreciated by one of ordinary skill in the art having the benefit of this disclosure. As shown in FIG. 2B, the override valve 75 bypasses the valves 21, 41 and the pin puller 31 used to launch the lower cement plug from the cement head and also bypass the valves 100, 120 and the pin puller 110 used to launch the upper cement plug from the cement head. Instead, the override valve 75 is connected directly to the upper cement head valve 140, the middle cement head valve 61, and the lower cement head valve 81 and thus, may be used to actuate each of the cement head valves 61, 81, and 140 simultaneously.

Figure 3A:
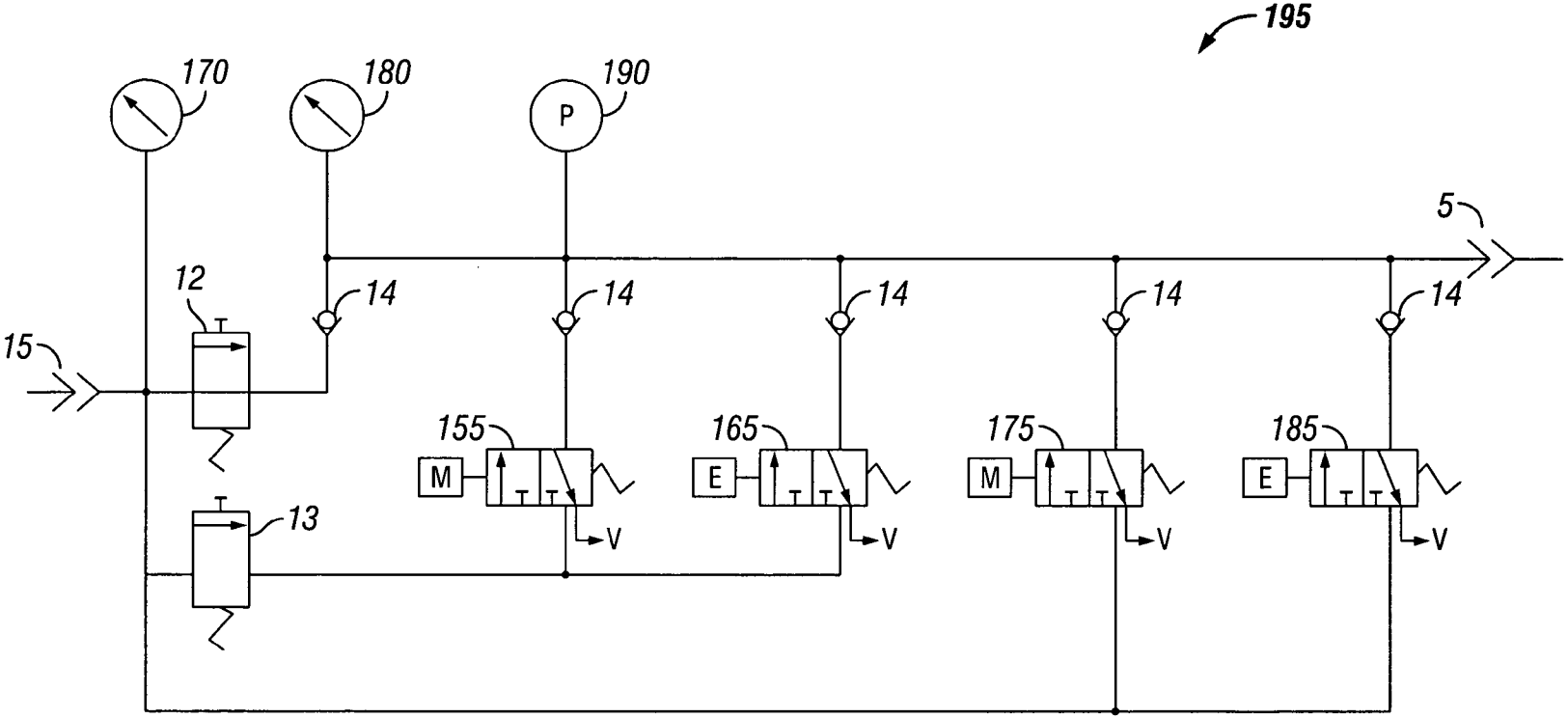
FIG. 3A shows a schematic of one embodiment of a remote control used to launch a cement plug from a cement head.

FIG. 3A shows a schematic of one embodiment a remote controller 195 for launching cement plugs from a cement head. The remote controller 195 is connected to an air supply 15 and includes a gauge 170 to monitor the air supply 15. The air supply 15 is connected to a first pressure regulator 12 and a second pressure regulator 13. The pressure regulators are on parallel with the number of valves used to remotely access the system and launch a cement plug. The number of pressure regulators and valves may be varied depending on the number of cement plugs to be launched from the cement head as would be appreciated by one of ordinary skill in the art having the benefit of this disclosure.

The first pressure regulator 12 is set to keep the pressure within the remote controller at a pressure below a first predetermined pressure, such as keeping the pressure at 85 psi below a first predetermined pressure of 90 psi. The first predetermined pressure 90 is used to launch a cement plug from the cement head. The remote controller 195 is connected to a pneumatic line 5 connected to the cement head. Thus, the remote controller 195 is used to control the pressure in the pneumatic line 5 connected to the cement head.

Valves 155 and 165 may be connected in parallel to a second pressure regulator 13. The second pressure regulator 13 may be adapted to raise the pressure within the remote controller 195 to the first predetermined pressure. Valve 165 may be adapted to be actuated by an electronic device from a remote location. Valve 155 may be actuated to launch the cement plug from the cement head. A number of valves 14, such as a ball valve for example, may be used to limit the pressurized flow to one direction through the remote controller 195.

Valves 175 and 185 may be connected in parallel to the air supply 15 and may be used to remotely flush the cement head. The remote controller may include a gauge 180 to monitor the control air and may include a pressure transducer 190 to monitor the pressure being supplied to the pneumatic line 5 to the cement head.

Figure 3B:
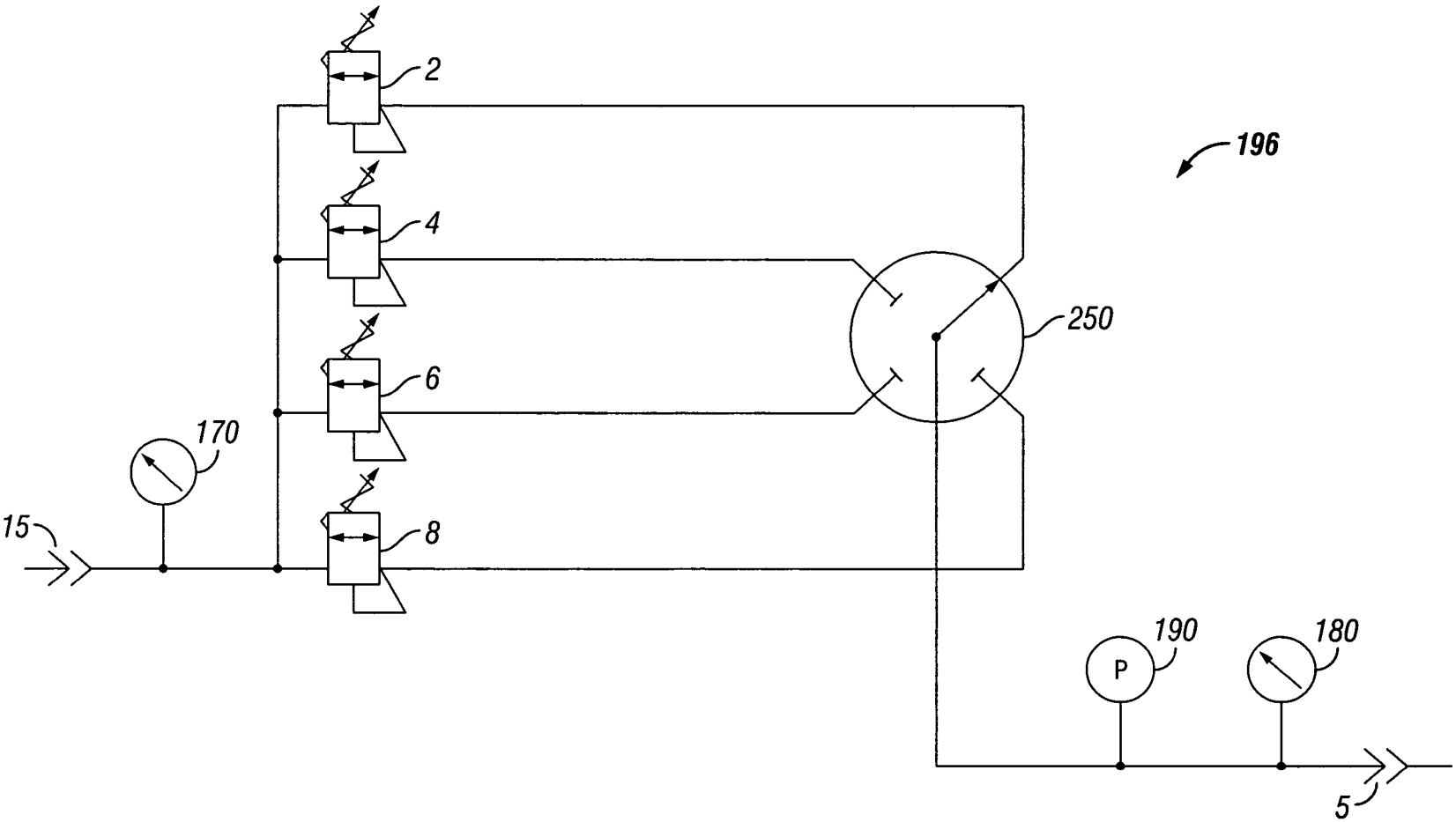
FIG. 3B shows a schematic of one embodiment of a remote control that uses a rotary switch to launch a cement plug from a cement head.

FIG. 3B shows a schematic of one embodiment a remote controller 196 that uses a rotary switch 250 for the launching of cement plugs from a cement head. The remote controller 196 is connected to an air supply 15 and includes a gauge 170 to monitor the air supply 15. The air supply 15 is connected to a plurality of pressure regulators 2, 4, 6, and 8 configured in parallel with the rotary switch 250. The rotary switch 250 is connected to a pneumatic line 5 connected to the cement head. The remote controller 196 may include a gauge 180 to monitor the control air and may also include a pressure transducer 190 to monitor the pressure being supplied to the pneumatic line 5.

One pressure regulator 2 may be used to raise the pressure within the pneumatic line 5 to a predetermined pressure necessary to open each of the valves on the cement head. Likewise, one pressure regulator 4 may be used to raise the pressure within the pneumatic line 5 to a predetermine pressure necessary to close each of the valves on the cement head. A third pressure regulator 6 may be used to raise the pressure within the pneumatic line 5 to the predetermined amount necessary to launch the top plug from the cement head. A fourth pressure regulator 8 may be used to raise the pressure within the pneumatic line 5 to the predetermine amount necessary to launch the bottom plug from the cement head. The rotary switch 250 may be used to connect the pneumatic line to the appropriate pressure regulator 2, 4, 6, and 8 to perform a desired operation within the cement head. The number of pressure regulators may be varied depending on the number of cement plugs to be launched from the cement head as would be appreciated by one of ordinary skill in the art having the benefit of this disclosure.

Figure 4:
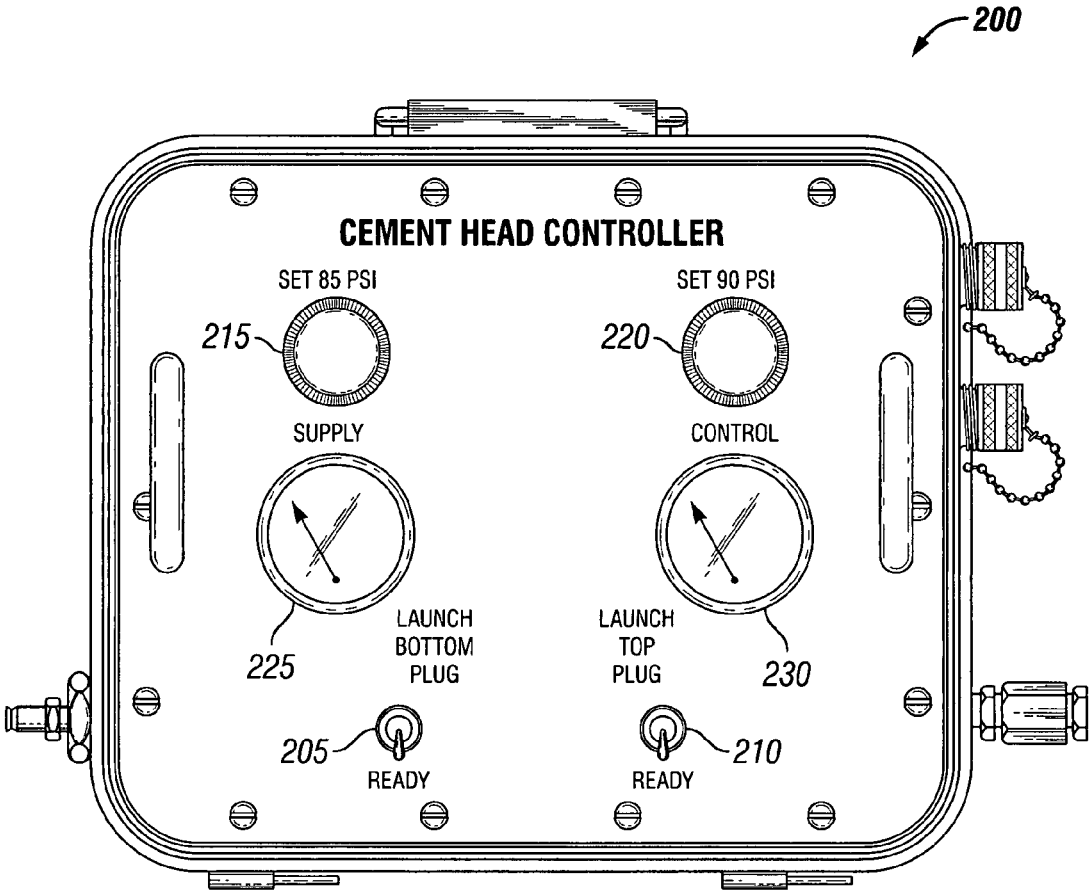
FIG. 4 shows one embodiment of a controller that may be used to launch a cement plug from a cement head.

FIG. 4 shows one embodiment of a control box 200 that may be used to launch cement plugs from a cement head. The control box 200 includes a gauge 225 to monitor the air supply and a gauge 230 to monitor the pressure supplied to the pneumatic line. The control box 200 includes a switch to set the pressure within the pneumatic line to a first amount, such as 85 psi for example. The control box includes a switch to increase the pressure to a second amount, such as 90 psi. The control box also includes a switch to launch the bottom plug and a switch 210 used to launch a top plug. The number and configurations of the switches of the control box 200 are shown for illustrative purposes only. The number and configuration of switches may be adapted to launch a various number of cement plugs as would be appreciated by one of ordinary skill in the art having the benefit of this disclosure.

Figure 5:
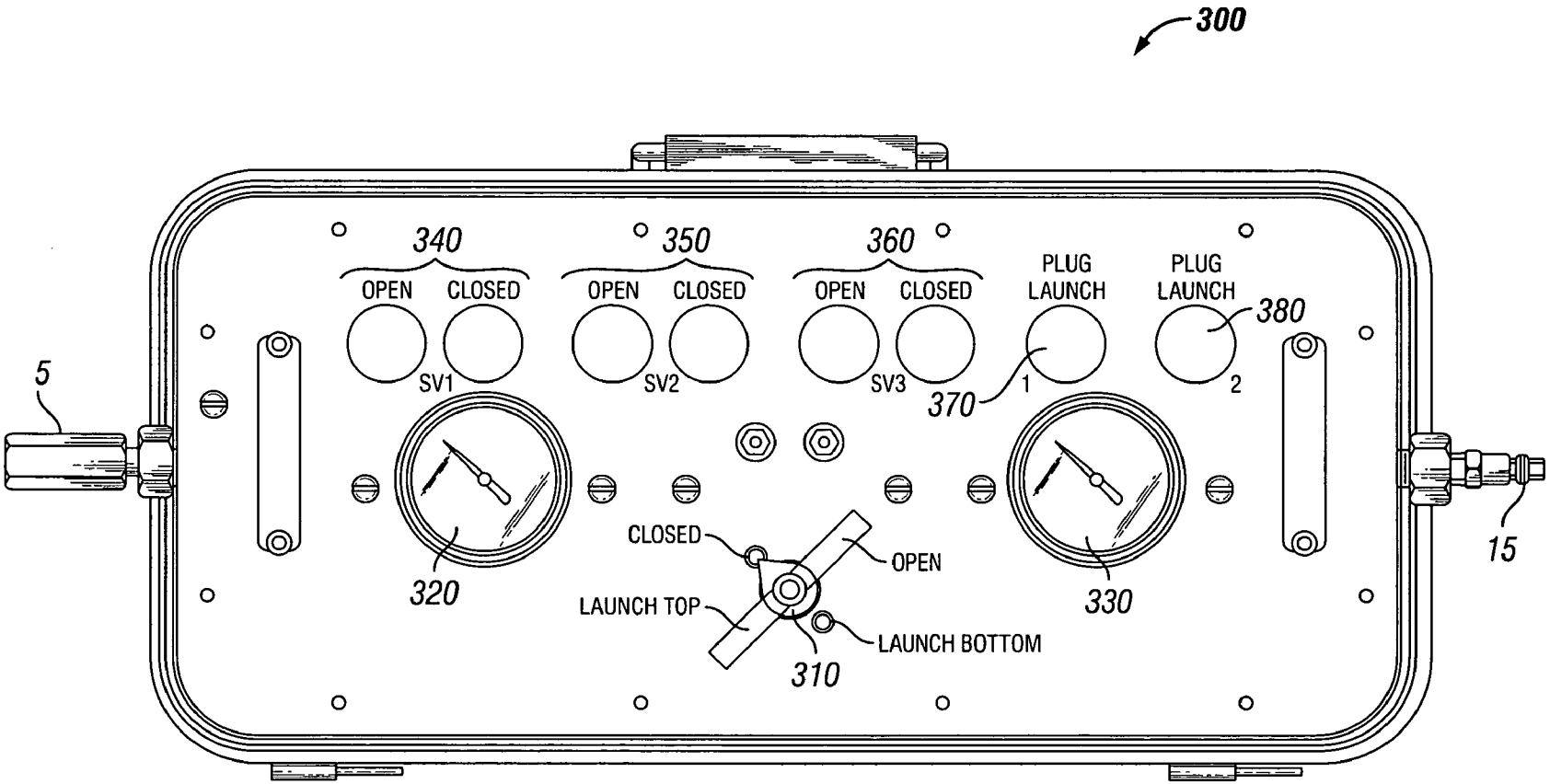
FIG. 5 shows one embodiment of a controller that may be used to launch a cement plug from a cement head, the controller including electrical indicators that indicate the status of the cement head valves.

FIG. 5 shows one embodiment of a control box 300 that may be used to launch cement plugs from a cement head. The control box 300 includes a gauge 320 to monitor the air supply and a gauge 330 to monitor the pressure supplied to the pneumatic line. The control box 300 includes a switch 310 that may be used to close the cement head valves, open the cement head valves, launch a top cement plug, or launch a bottom cement plug. The control box 300 also includes indicators 340, 350, and 360 to indicate the status of the cement head valves. The control box 300 also includes indicators 370, 380 that indicate whether each cement plug has been launched. The number and configuration of the indicators and switches of the control box 300 are shown for illustrative purposes only. The number and configuration of switches may be adapted to launch a various number of cement plugs as would be appreciated by one of ordinary skill in the art having the benefit of this disclosure.

Although various embodiments have been shown and described, the invention is not so limited and will be understood to include all such modifications and variations as would be apparent to one skilled in the art.

What is claimed is:

1. A system for launching a cement plug from a cement head, the cement head including a first retaining device movable from a first position that retains a first cement plug in the cement head to a second position that allows the first cement plug to exit the cement head, the system comprising:

a single pneumatic line to provide a pressurized gas to the system in order to automate the launching of the cement plug, wherein the automation is accomplished by varying a pressure of the pressurized gas in the single pneumatic line;

a first device being in communication with the single pneumatic line, the first device being adapted to move the first retaining device from its first position to its second position, wherein the first device moves the first retaining device to its second position when the pressure within the single pneumatic line reaches a first designated amount;

a first valve in communication with a first port in the cement head located below the first cement plug, the first valve being movable between an open position and a closed position;

a second valve in communication with a second port in the cement head located above the first cement plug, the second valve being movable between an open position and a closed position;

wherein the second valve is biased to its closed position until the first retaining device has been moved to the second position; and wherein the first valve is biased to its open position until the second valve has been opened.

2. The system of claim 1 further comprising a first pressure regulator, wherein the first pressure regulator is in communication with the single pneumatic line and is biased to keep the pressure less than the first designated pressure until a cement plug is to be launched from the cement head.

3. The system of claim 2 further comprising a first control valve being in communication with the single pneumatic line, the first control valve being adapted to actuate the first valve between its open position and its closed position.

4. The system of claim 3 further comprising a second control valve being in communication with the single pneumatic line, the second control valve being adapted to actuate the second valve between its open position and its closed position.

5. The system of claim 1 further comprising an override pressure regulator and an override control valve, wherein the override pressure regulator and override control valve may be used to simultaneously actuate the first valve and the second valve.

6. The system of claim 2 further comprising:

a second device being in communication with the pneumatic line, the second device being adapted to move a second retaining device of the cement head from a first position that retains a second cement plug in the cement head to a second position that allows the second cement plug to exit the cement head, wherein the second device moves the second retaining device to its second position when the pressure within the pneumatic line reaches a second designated amount;

a third valve in communication with a third port in the cement head located above the second cement plug, the third valve being movable between an open position and a closed position;

wherein the third valve is biased to its closed position until the second retaining device has been moved to its second position; and wherein the second valve remains in its open position after the first retaining device has been moved to the second position until the third valve has been opened.

7. The system of claim 6 wherein a second pressure regulator raises the pressure in the pneumatic line to the first designated amount upon receiving a signal to launch the first cement plug.

8. The system of claim 7 further comprising a third control valve being in communication with the pneumatic line, the third control valve being adapted to actuate the third valve between its open position and its closed position.

9. The system of claim 7 wherein a third pressure regulator raises the pressure in the pneumatic line to the second designated amount upon receiving a signal to launch the second cement plug.

10. The system of claim 9 wherein a wireless remote may be used to control the first, second or third pressure regulator.

11. The system of claim 10 wherein the wireless remote includes a rotary switch.

12. The system of claim 6 wherein a wireless remote may be used to control the pressure regulator.

13. The system of claim 1 further comprising a controller, wherein the controller is used to vary the amount of pressure in the pneumatic line.

14. The system of claim 1 wherein the controller indicates the status of each valve and the status of the cement plug.

15. A method of remotely launching cement plugs from a cement head, the method comprising:

raising a pressure in a single pneumatic line to a first designated pressure, wherein the single pneumatic line is in communication with the cement head;

removing a first pin from the cement head, the first pin retains a first cement plug in the cement head, wherein the first pin is pneumatically removed after the pressure in the single pneumatic line reaches the first designated pressure;

opening a valve located above the first cement plug on the cement head, wherein the valve is pneumatically biased closed until the first pin has been removed from the cement head;

pumping cement though the valve above the first cement plug; and closing a valve located below the first cement plug on the cement head, wherein the valve is pneumatically biased open until the valve above the first cement plug has been opened.

16. The method of claim 15 further comprising regulating the pressure in the single pneumatic line.

17. The method of claim 16 wherein the pressure in the single pneumatic line is remotely regulated.

18. The method of claim 15 further comprising:

raising the pressure in the single pneumatic line to a second designated pressure;

removing a second pin from the cement head, the second pin retains a second cement plug in the cement head, wherein the second pin is pneumatically removed after the pressure in the single pneumatic line reaches the second designated pressure;

opening a valve located above the second cement plug on the cement head, wherein the valve is pneumatically biased closed until the second pin has been removed from the cement head;

pumping cement through the valve above the second cement plug; and closing the valve located above the first cement plug on the cement head, wherein the valve is located below the second cement plug.

19. The method of claim 18 further comprising regulating the pressure in the single pneumatic line.

20. The method of claim 19 wherein the pressure in the single pneumatic line is remotely regulated.

21. A system for launching multiple cement plugs from a cement head, the system comprising:

a single line connected to an air supply, wherein the pressure within the single line may be varied between a plurality of pressure amounts in order to launch the multiple cement plugs from the cement head;

a first valve in communication with the single line, the first valve being movable to open and close a first port on the cement head, wherein the valve opens the first port when the pressure in the single line is at a first pressure amount and closes when the pressure in the single line is above the first pressure amount;

a second valve in communication with the single line, the second valve being movable to open and close a second port on the cement head, wherein the valve opens the second port when the pressure in the single line is at a second pressure amount and closes the second port when the pressure is at the first pressure amount or when the pressure is at a third pressure amount; and a first device to release a first cement plug within the cement head, wherein the device releases the first cement plug when the pressure within the single line is at the second pressure amount.

22. The system of claim 21 further comprising:

a third valve in communication with the single line, the third valve being movable to open and close a third port on the cement head, wherein the valve opens the third port when the pressure in the single line is at the third pressure amount; and a second device to release a second cement plug within the cement head, wherein the device releases the second cement plug when the pressure within the single line is at the third pressure amount.

23. A method for remotely launching cement plugs from a cement head, the method comprising the steps of:

(a) providing a controller remote from the cement head;

(b) connecting a single pneumatic line between the controller and cement head;

(c) communicating pressurized gas through the single pneumatic line to the cement head;

(d) varying the pressure of the gas through the single pneumatic line; and (e) automatically launching the cement plugs from the cement head in response to step (d).

24. A method as defined in claim 23, wherein step (d) further comprises the steps of:

raising the pressure of the gas through the single pneumatic line to a first predetermined pressure to release a first cement plug; and raising the pressure of the gas through the single pneumatic line to a second predetermined pressure to release a second cement plug.

25. A method as defined in claim 23, wherein step (d) is accomplished using the remote controller.

* * * * *